US006181889B1

(12) United States Patent
Hayano et al.

(10) Patent No.: US 6,181,889 B1
(45) **Date of Patent: *Jan. 30, 2001**

(54) IMAGE FORMING APPARATUS WITH REDUCED LATENT IMAGE VIBRATION CAUSED BY PHOTOSENSITIVE BELT JOINT

(75) Inventors: Tomio Hayano, Hitachi; Tetsuro Akasaki, Hitachinaka; Kazuhiro Wakamatsu, Hitachi; Isamu Terashima, Hitachi; Shoji Ukei, Hitachi, all of (JP)

(73) Assignee: Hitachi, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/803,826

(22) Filed: Feb. 24, 1997

(30) Foreign Application Priority Data

Feb. 27, 1996 (JP) ..... 8-39288

(51) Int. Cl.[7] ..... G03G 15/043
(52) U.S. Cl. ..... 399/51; 399/162
(58) Field of Search ..... 399/32, 51, 160, 399/302, 164, 167, 162, 313; 347/247

(56) References Cited

U.S. PATENT DOCUMENTS

| | | | | |
|---|---|---|---|---|
| 4,437,757 | * | 3/1984 | Komori et al. | 399/160 |
| 4,596,457 | * | 6/1986 | Peeters et al. | 399/160 |
| 5,258,816 | * | 11/1993 | Haneda et al. | 399/345 |
| 5,341,194 | * | 8/1994 | Haneda et al. | 399/160 |
| 5,652,948 | * | 7/1997 | Sagaguchi et al. | 399/297 |
| 5,666,599 | * | 9/1997 | Miyasaka et al. | 399/302 |

FOREIGN PATENT DOCUMENTS

| | | | |
|---|---|---|---|
| 61-185753 | | 8/1986 | (JP) . |
| 63-265280 | * | 11/1988 | (JP) . |
| 1-288860 | | 11/1989 | (JP) . |
| 6-95461 | * | 4/1994 | (JP) . |
| 7-325455 | * | 12/1995 | (JP) . |

* cited by examiner

*Primary Examiner*—Quana M. Grainger
(74) *Attorney, Agent, or Firm*—Antonelli, Terry, Stout & Kraus, LLP

(57) ABSTRACT

An image forming apparatus in which a distance along a photosensitive belt from a cleaning unit to an exposing position is set to be shorter than a distance from the rear end of a print image to the front end of the following print image, so that a latent image is not formed by an exposing unit when a joint of the photosensitive belt passes the cleaning unit.

12 Claims, 4 Drawing Sheets

IMAGE FORMING APPARATUS WITH REDUCED LATENT IMAGE VIBRATION CAUSED BY PHOTOSENSITIVE BELT JOINT

BACKGROUND OF THE INVENTION

The present invention relates to an image forming apparatus of an electrophotographic system, such as a copying machine or laser printer, and more particularly, to an image forming apparatus having a belt-shaped photosensitive member.

An electrophotographic apparatus, such as an electrophotographic copying machine or electrophotographic printer, generally comprises; a photosensitive member, such as a photosensitive drum or a photosensitive belt; a charging unit for uniformly charging the surface of the photosensitive member; an exposing unit for exposing the surface of the photosensetive member to light in accordance with image information, thereby forming an electrostatic latent image on the charged surface of the photosensitive member; a transfer unit for transferring a toner image to a recording sheet; and a thermal fixing unit fixing the toner image onto the recording sheet, wherein the recording sheet on which the toner image has been transferred passes through the thermal fixing unit.

In an image forming apparatus of the electrophotographic type using a photosensitive belt, the photosensitive belt has generally a joint so as to be endless. When the joint passes the cleaning unit, the cleaning unit is vibrated due to a difference in level at the joint. Because of the vibration, a photosensitive belt unit is also vibrated. When a latent image is formed by the exposing unit, the latent image is consequently vibrated so that a density variation in a lateral line shape which is perpendicular to the paper conveyance direction occurs on the image. Since the density variation remarkably deteriorates the quality of the image, the vibration of the cleaning unit has to be prevented in order to prevent such a density variation. Therefore, various processing methods for reducing the difference in level at the joint of the photosensitive belt have been conventionally proposed.

For example, Japanese Patent Application Laid-Open No. 1-288860 discloses a method in which the ends of a belt are connected by ultrasonic fusion and an extruded length from the joint portion is set to 1.2 mm or shorter. Japanese Patent Application Laid-Open No. 61-185753 discloses a method of forming a protective film including a solid lubricant in the joint portion.

According to the conventional methods, as mentioned above, the latent image is vibrated by the vibration which occurs when the photosensitive belt passes the cleaning unit due to the joint in the photosensitive belt. The joint is the cause of occurrence of a density variation in the image, so that the joint is processed to reduce the difference in level in order to prevent the vibration. Although the density variation in the image is suppressed by reducing the difference in level by processing the joint, all of the variation is not eliminated. The process cannot be perfectly executed by variation in processing works.

SUMMARY OF THE INVENTION

It is an object of the invention to provide a photosensitive belt which does not cause vibration when a joint of the photosensitive belt passes a cleaning unit and which prevents occurrence of a density variation in an image and also to provide an image forming apparatus having the photosensitive belt.

According to the invention, there is provided an image forming apparatus in which electrostatic latent images are formed into toner image using color toner on an endless photosensitive belt having a photoconductive face on which the electrostatic latent image can be formed, and after that, the latent images are sequentially piled up on an intermediate transfer drum and are simultaneously transferred to a recording sheet. The apparatus comprises a photosensitive belt; a charging unit for uniformly charging the surface of the photosensitive belt so as to have a predetermined potential; an exposing unit for forming an electrostatic latent image on the uniformly charged surface; a developing unit for forming a toner image from the electrostatic latent image using toner; an intermediate transfer drum for sequentially piling up the toner images; and a cleaning unit for removing residual toner after transfer of the toner image, wherein the photosensitive belt has a joint so as to be endless, and when the joint passes the cleaning unit, the latent image is not formed by the exposing unit.

Further, the travel distance of the photosensitive belt from the cleaning unit to the exposing unit is shorter than the distance from the rear end of a print image on the photosensitive belt to the front end of the following print image.

Further, the charging unit for charging the photosensitive belt so as to have a predetermined electric potential, the exposing unit for forming the electrostatic latent image, and the cleaning unit for removing residual toner after the toner image is transferred to the intermediate transfer drum are arranged around one of a plurality of rollers over which the photosensitive belt is stretched.

Further, the charging unit for charging the photosensitive belt so as to have a predetermined electric potential, the exposing unit for forming the electrostatic latent image, and the cleaning unit for removing residual toner after the toner image is transferred to the intermediate transfer drum are arranged around a drive roller which applies a conveyance force to the photosensitive belt.

With the above construction, a latent image with high accuracy can be formed on the photosensitive belt without being influenced by vibration caused when the joint of the photosensitive belt passes the cleaning unit.

DETAILED DESCRIPTION OF THE PREFERRED EMBODIMENT

Figure 2:
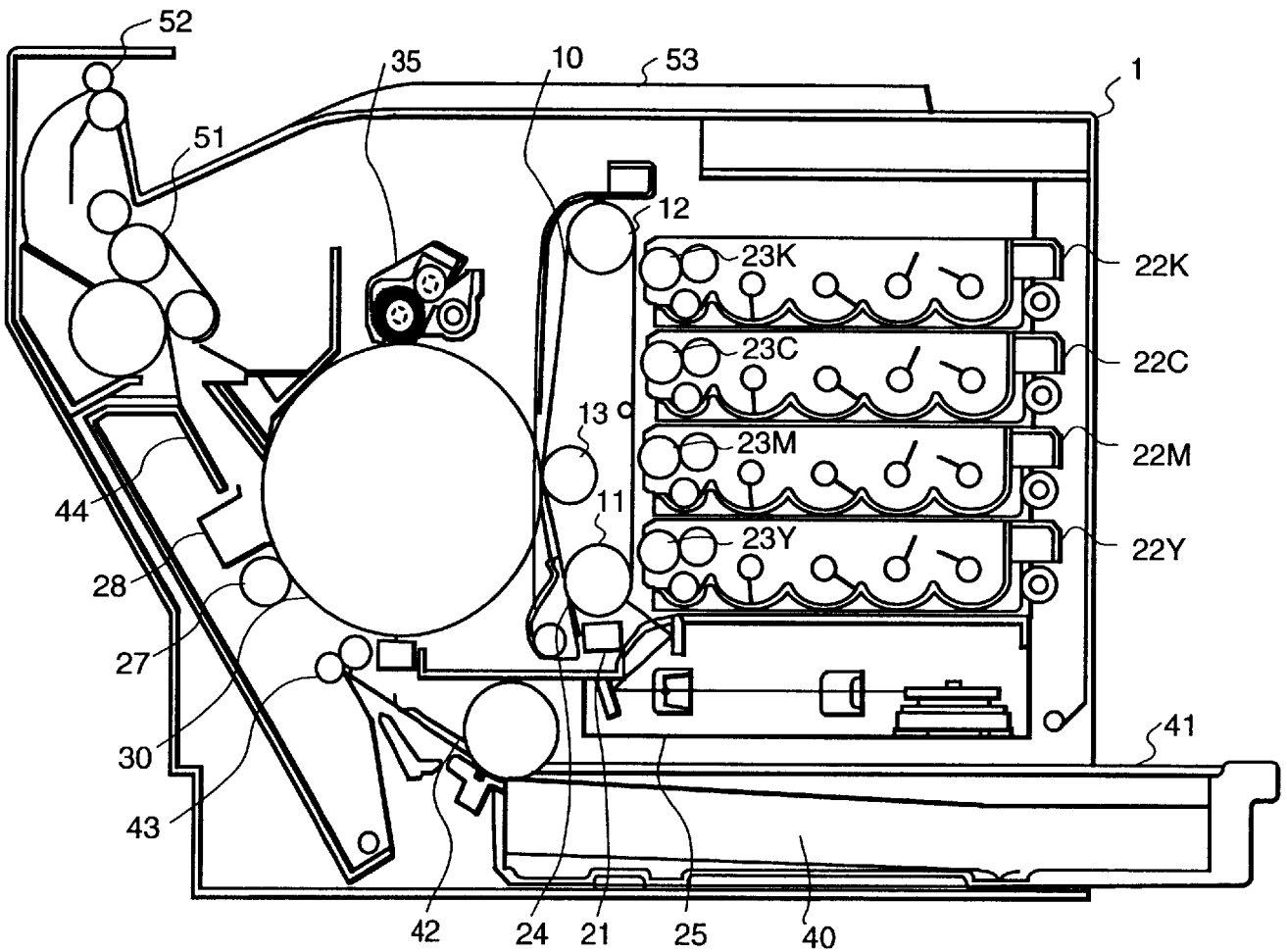
FIG. 2 is a side view illustrating a construction of the image forming apparatus according to the embodiment of the invention.

An embodiment of the invention will be described with reference to the drawings. FIG. 2 shows a construction of an image forming apparatus main body to which the invention is applied. The image forming apparatus which performs color printing is shown in FIG. 2.

In FIG. 2, a photosensitive belt 10 driven by rollers 11, 12 is provided in the center of a printer body 1. A charging unit 21, an exposing unit 25 which turns on/off a laser according to information from the host, thereby forming an electrostatic latent image on the photosensitive belt 10, a developing unit 22Y for the yellow color, a developing unit 22M for the magenta color, a developing unit 22C for the cyan color, a developing unit 22K for the black color, and a cleaning unit 24 are provided around the photosensitive belt 10. Development rollers 23Y, 23M, 23C, and 23K are rotatably axially supported in the developing units of the respective colors. An intermediate transfer drum 30 is provided on the left side of the photosensitive belt 10 so as to come into contact with the belt 10. An intermediate transfer drum cleaner 35 is provided on the intermediate transfer drum 30. A paper cassette 41 and a paper feed roller 42 are provided in the lower part of the printer 1. A resistance roller 43, a transfer roller 27, a discharging unit 28, a conveyance guide 44, a fixing unit 51, and a paper ejecting roller 52 are provided in the left part of the printer 1. A paper ejecting tray 53 is provided on the printer 1.

The operation will be described hereinbelow, however, a detailed description regarding the color print forming steps by repeated development is omitted here.

When the color printing is started (the operation of monochrome printing is almost the same as that of the color printing), a laser is turned on/off according to information concerning the respective colors sent from the host, thereby forming electrostatic latent images of respective colors on the photosensitive belt 10. The formed electrostatic latent image is developed by the developing unit of the corresponding color, thereby forming a toner image. The toner images formed on the photosensitive belt 10 are sequentially transferred to the intermediate transfer drum 30 and are piled up on the intermediate transfer drum 30, thereby forming a color toner image. On the other hand, a sheet 40 of paper is fed from the paper cassette 41 by the paper feed roller 42 and is conveyed to the resistance roller 43. The resistance roller 43 starts rotating in accordance with the position of the color image on the intermediate transfer drum 30 to feed the sheet 40 to the transfer roller 27.

At a timing when the sheet 40 is fed to the transfer position, the transfer roller 27 rotates in a direction to come into contact with the intermediate transfer drum 30 and is simultaneously turned on. Consequently, the color image on the intermediate transfer drum 30 is transferred onto the sheet 40.

The sheet 40 is charged by a voltage applied by the transfer roller 27. The charged sheet 40 is caused to adhere to the intermediate transfer drum 30 according to the relation of its charge with the electric potential of the intermediate transfer drum 30. However, a part of the charges of the sheet 40 is eliminated by the action of the discharging unit 28 and the adhering force by static electricity is reduced, so that the sheet 40 comes off. After that, the sheet 40 is fixed by the fixing unit 51 and is ejected to the paper ejecting tray 53.

Figure 1:
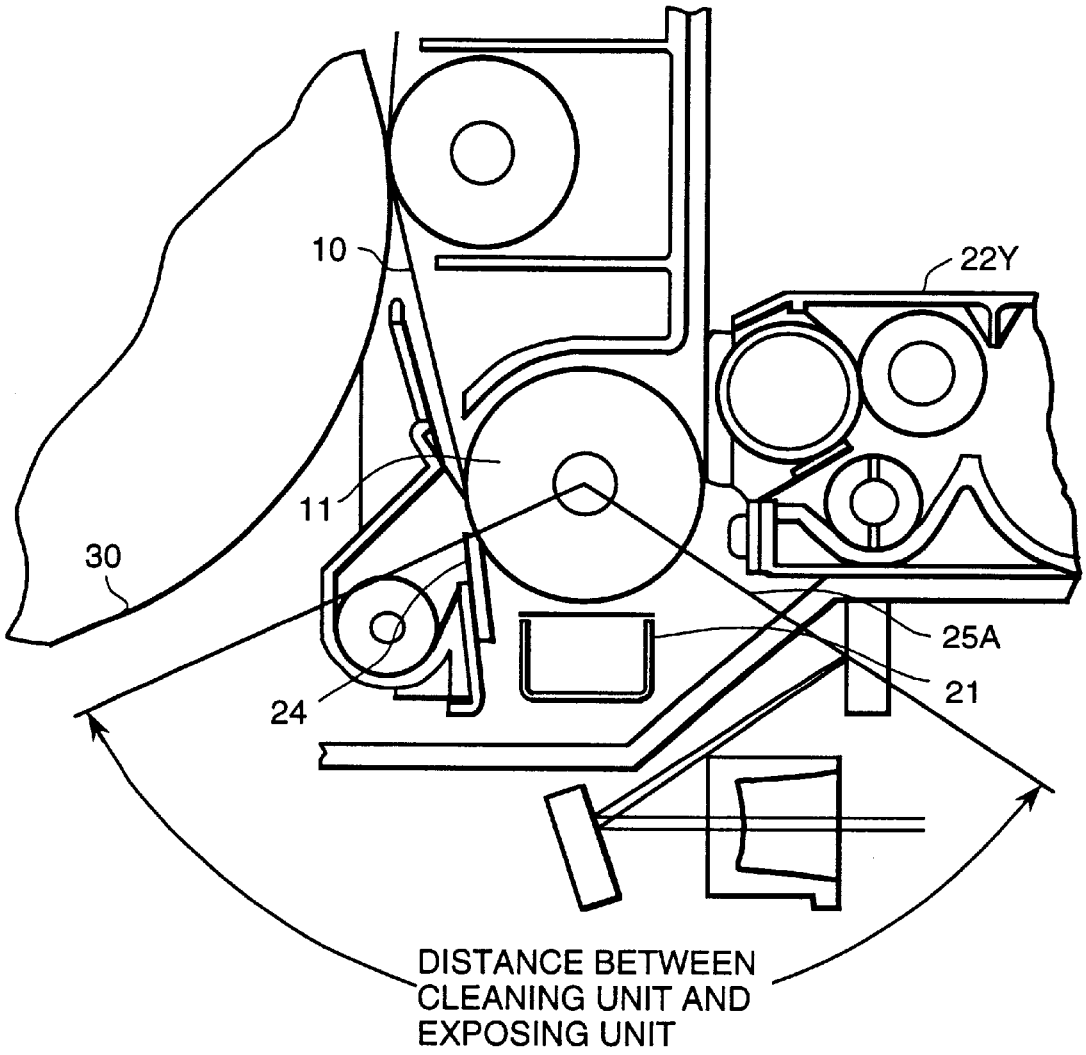
FIG. 1 is a cross section of an image forming apparatus according to an embodiment of the invention.
Figure 3:
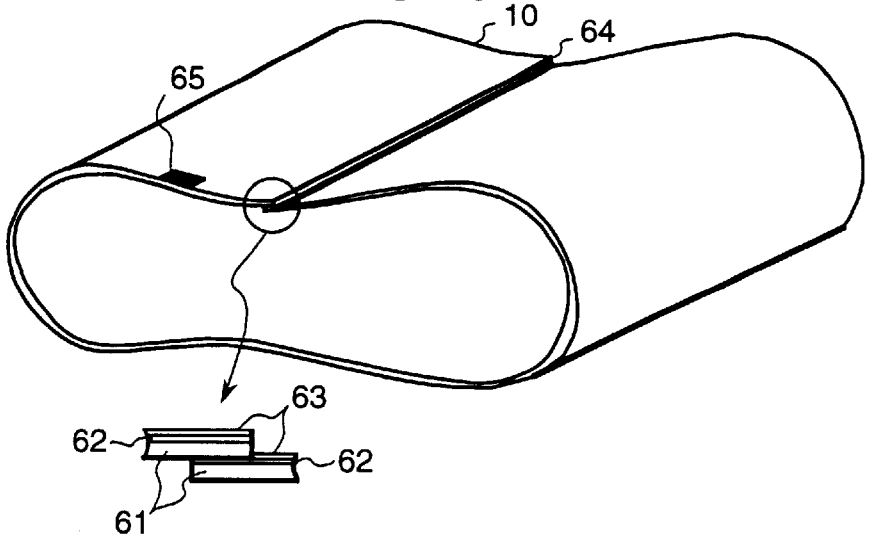
FIG. 3 is a perspective view of a photosensitive belt according to the embodiment of the invention.
Figure 4:
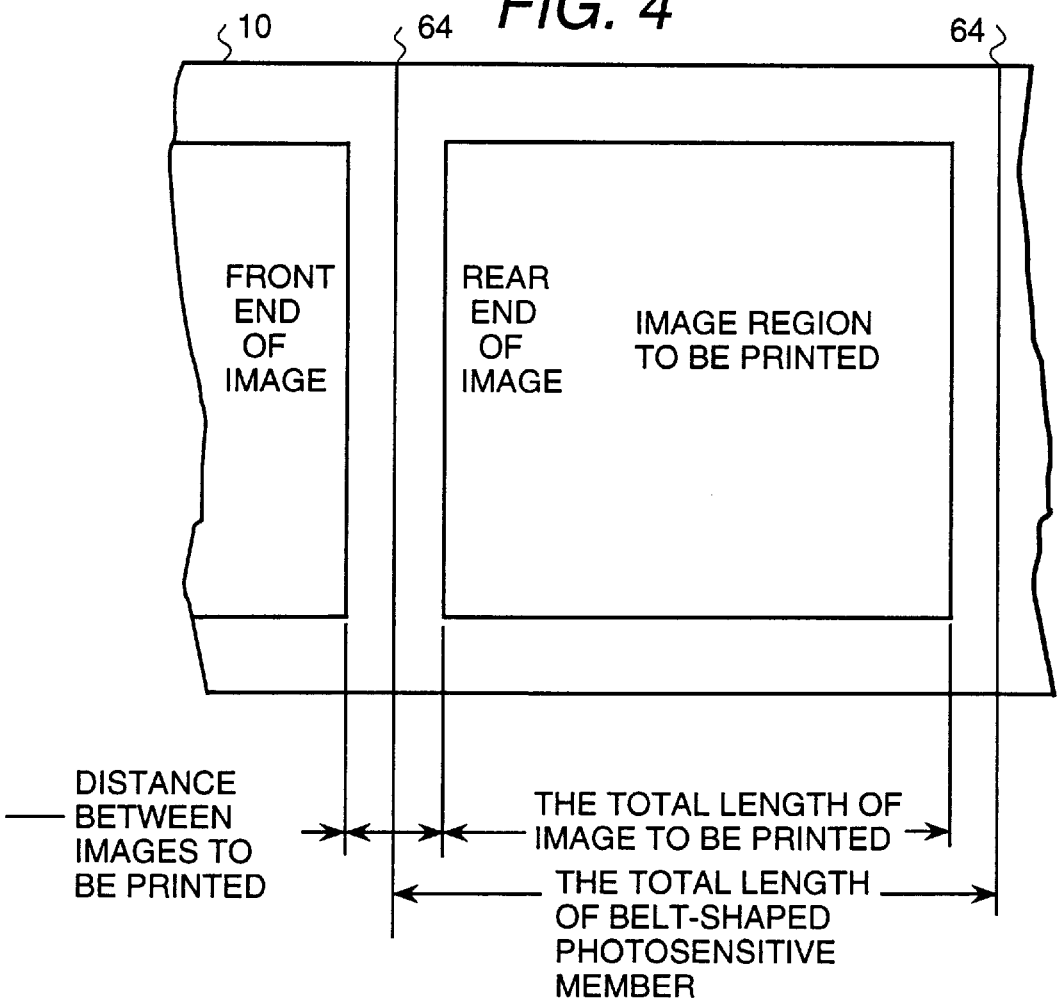
FIG. 4 is a diagrammatic view illustrating a position of an image on the photosensitive belt according to the embodiment of the invention.

The invention will be described in detail with reference to FIGS. 1, 3, and 4. FIG. 1 is an enlarged sectional view of a part of the image forming apparatus. FIG. 3 is a perspective view of the photosensitive belt and a sectional view of the main portion. FIG. 4 is a view illustrating an image area on the photosensitive belt. As shown in FIG. 1, the photosensitive belt 10 is stretched in an almost triangular shape over a drive roller 11 and driven rollers 12 and 13. The charging unit 21, a laser beam 26, developing units 22Y, 22M, 22C, 22K, intermediate transfer drum 30, and cleaning unit 24 are arranged around the photosensitive belt 10.

As shown in FIG. 3, in the photosensitive belt 10, an aluminum electrode 62 and a photoconductor 63 are piled up on a sheet-shaped elastic member, such as a polyethylene terephthalate film 61 (hereinlater, called PET film) so as to form a layer. Generally, both ends are connected by means of ultrasonic fusion or the like. Consequently, there is a joint 64 at the ends. The joint 64 has portions with a difference in level due to the overlap of the PET film 61 and toner tends to accumulate in the transition area. Therefore, when an image is formed on the joint 64, the line of the joint 64 appears on a printed image, and the quality of the image deteriorates remarkably. In order to prevent this the photosensitive belt 10 has a marker 65 by which the position of the joint 64 is detected. The marker 65 is sensed by a photo sensor and the location of an electrostatic latent image is controlled so as not to be on the joint 64.

However, even when no image is formed on the joint 64, in the case where the joint 64 passes the cleaning unit 24 just when the exposure is performed by the exposing unit 25 and an electrostatic latent image is formed, the image forming apparatus including the photosensitive belt 10 is vibrated by an impact when the cleaning unit 24 passes over the area of different level of the joint 64. When the cleaning unit 24 passes over the area of different level of the joint 64, the conveyance speed of the photosensitive belt 10 is also sightly changed. Thus, exposure by the exposing unit 25 is deviated subtly, and a density variation, i.e. a so called jitter, occurs perpendicularly in the conveyance direction on the printed image. In order to prevent the occurrence of the jitter, the apparatus should be constructed in such a manner that the joint 64 of the photosensitive belt 10 does not pass the cleaning unit 24 while the electrostatic latent image is being formed by the exposing unit 25.

Figure 5:
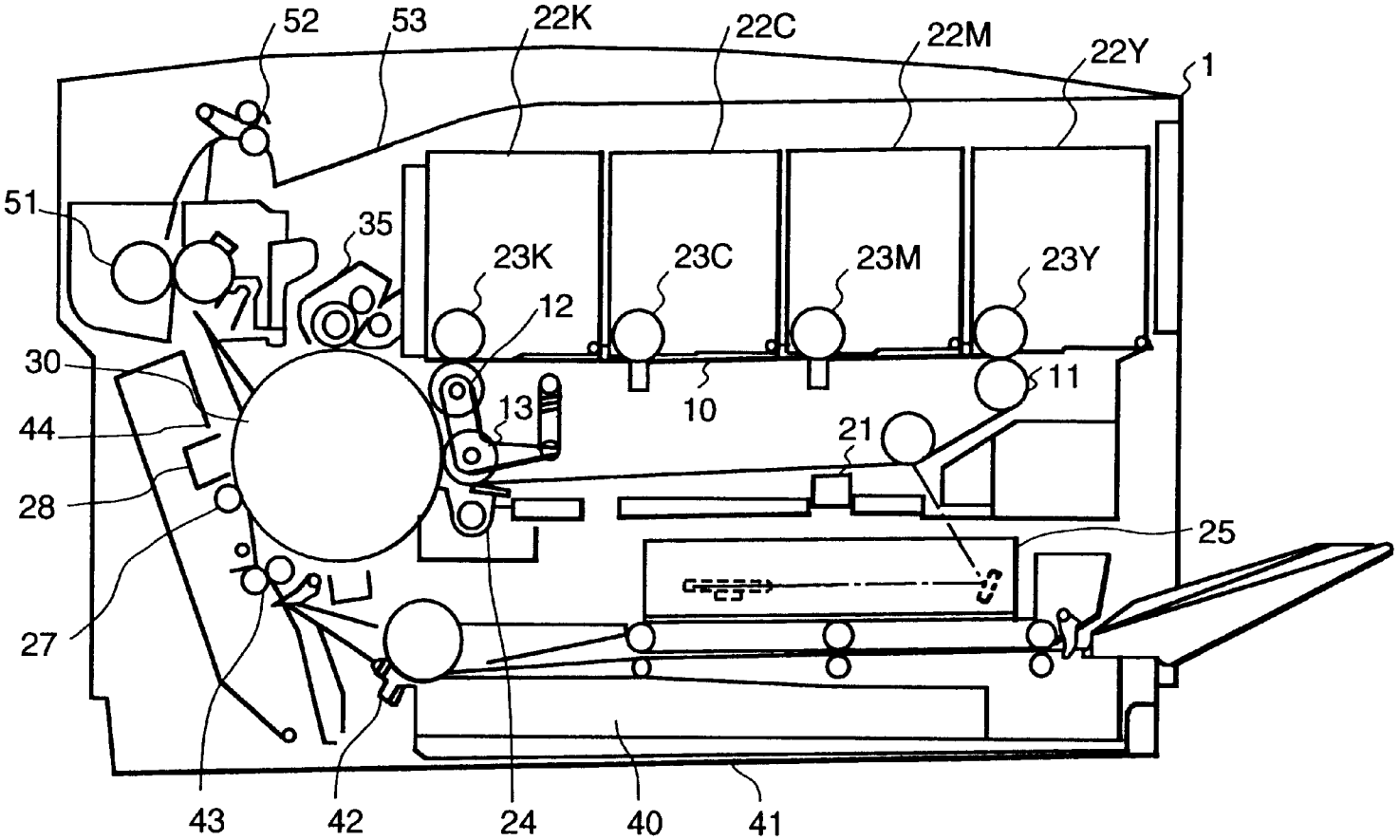
FIG. 5 (PRIOR ART)
FIG. 5 is a side view illustrating a construction of a conventional image forming apparatus.

FIG. 5 shows a conventional image forming apparatus. Since the distance from the cleaning unit 24 to the exposing unit 25 is long, the joint 64 of the photosensitive belt 10 passes the cleaning unit 24 while the electrostatic latent image is being formed by the exposing unit 25. Jitter consequently occurs and the quality of the image deteriorates. In order to prevent this, when the apparatus is constructed so that the joint 64 does not pass the cleaning unit 24 while the electrostatic latent image is being formed by the exposing unit 25, the non-print area on the photosensitive belt 10 becomes large and the utilization efficiency of the belt is poor.

As shown in FIG. 1, the apparatus is therefore constructed in such a manner that the distance from the cleaning unit 24 to the exposing unit 25 is shortened and the joint 64 of the photosensitive belt 10 passes the cleaning unit 24 after completion of the exposure. With such a construction, a printed image without a density variation can be obtained.

FIG. 4 is a diagram showing an image position on the photosensitive belt 10 according to the embodiment of the invention. The distance of the photosensitive belt 10 from the cleaning unit 24 to an exposure position 25A shown in FIG. 1 is set to be shorter than the distance from the rear end of a print image on the photosensitive belt 10 to the front end of the following print image. By setting the length as mentioned above, it is possible to prevent the joint 64 of the photosensitive belt 10 from passing through the cleaning unit 24 while the latent image is being formed by the exposing unit 25. Thus, by setting the length as mentioned above, so a printed image without a density variation can be obtained.

As shown in FIG. 1, the charging unit 21 for charging the photosensitive belt 10 so as to have a predetermined electric potential, the exposing position 25A of the exposing unit 25 which forms the electrostatic latent image, and the cleaning unit 24 for eliminating residual toner after a toner image is transferred to the intermediate transfer drum 30 are arranged around one of a plurality of rollers over which the photosensitive belt 10 is stretched, for example, the drive roller 11, thereby enabling the distance from the cleaning unit 24 to the exposing position 25A to be shortened. By arranging the above units around the roller, members conventionally installed so as to face the cleaning unit 24, charging unit 21, and exposing unit 25 as shown in FIG. 5 become unnecessary. Thus, the number of parts can be reduced and the cost of manufacture can be reduced. Further, any transmission of a vibration by the cleaning unit 24 is suppressed and any fluctuation of the load when the joint 64 of the photosensitive belt 10 passes the cleaning unit 24 can be absorbed. Further, an unevenness of charging and exposure due to the vibration of the face of the photosensitive belt 10 near the charging unit and the exposing unit can be prevented. Therefore, jitter and a density variation in the print image can be prevented and a print image of high quality can be obtained.

As mentioned above, the invention has effects such that when the photosensitive belt having a joint is used, any desirable influence due to the presence of the joint of the photosensitive belt can be avoided and the occurrence of a density variation in the image can be prevented.

Further, by arranging the charging unit for charging the photosensitive belt so as to have a predetermined electric potential, the exposing unit for forming the electrostatic latent image, and the cleaning unit for eliminating the residual toner after the toner image is transferred to the intermediate transfer drum around one of the plurality of rollers over which the photosensitive belt is stretched, the distance from the cleaning unit to the exposing unit can be shortened. Consequently, the apparatus can be miniaturized and the cost of manufacture can be reduced. By arranging the above units around the roller, there are effects such that vibrations produced by the cleaning unit are reduced and the unevenness of charging and exposure due to deviation of the face of the belt-shaped photosensitive member can be prevented. Thus, the deterioration of the image quality can be prevented.

Further, in the construction of the embodiment, the charging unit for charging the photosensitive belt so as to have a predetermined electric potential, the exposing unit for forming the electrostatic latent image, and the cleaning unit for eliminating the residual toner after the toner image is transferred to the intermediate transfer drum are arranged around the drive roller which applies the conveyance force to the photosensitive belt, thereby enabling the fluctuation of the load when the joint of the photosensitive belt passes the cleaning unit to be absorbed and any jitter in the print image to be prevented.

What is claimed is:

1. An image forming apparatus comprising:

a photosensitive belt having two ends joined together at a joint to form a loop;

a charging unit which uniformly charges the photosensitive belt to a predetermined electric potential at a charging position;

an exposing unit which forms an electrostatic latent image on the uniformly charged photosensitive belt in an image forming region on the photosensitive belt at an exposing position during an electrostatic image forming operation during which the photosensitive belt is conveyed past the exposing position;

a developing unit which develops the electrostatic latent image on the photosensitive belt with a toner, thereby forming a toner image on the photosensitive belt;

an intermediate transfer drum onto which the toner image on the photosensitive belt is transferred; and a cleaning unit which removes residual toner from the photosensitive belt at a cleaning position after the toner image on the photosensitive belt has been transferred to the intermediate transfer drum;

wherein the photosensitive belt is arranged so that the joint is outside the cleaning unit while the photosensitive belt is being conveyed past the exposing position during the electrostatic latent image forming operation; and wherein a distance along the photosensitive belt from the cleaning position to the exposing position is shorter than a distance along the photosensitive belt from a rear end of the image forming region on the photosensitive belt to a front end of the image forming region on the photosensitive belt.

2. An image forming apparatus according to claim 1, further comprising a plurality of rollers around which the photosensitive belt is stretched;

wherein the charging unit, the exposing unit, and the cleaning unit are arranged around one of the rollers.

3. An image forming apparatus according to claim 1, further comprising a drive roller around which the photosensitive belt is stretched, the drive roller imparting a driving force to the photosensitive belt to convey the photosensitive belt;

wherein the charging unit, the exposing unit, and the cleaning unit are arranged around the drive roller.

4. An image forming apparatus according to claim 1, wherein the developing unit sequentially forms a plurality of toner images on the photosensitive belt; and wherein the plurality of toner images are sequentially transferred from the photosensitive belt to the intermediate transfer drum where the plurality of toner images are stacked one on top of another to form a stacked toner image on the intermediate transfer drum.

5. An image forming apparatus comprising:

a housing;

a photosensitive belt having two ends joined together at a joint to form an elongated loop, the photosensitive belt being disposed in a center portion of the housing such that a long dimension of the elongated loop is oriented in a vertical direction;

a charging unit, disposed in the housing, which uniformly charges the photosensitive belt to a predetermined potential;

an exposing unit, disposed in the housing on a first side of the photosensitive belt relative to the long dimension of the elongated loop, which forms an electrostatic latent image on the uniformly charged photosensitive belt in an image forming region on the photosensitive belt at an exposing position during an electrostatic latent image forming operation during which the photosensitive belt is conveyed past the exposing position;

at least one developing unit, disposed in the housing on the first side of the photosensitive belt above the exposing unit, which develops the electrostatic latent image on the photosensitive belt with a toner, thereby forming a toner image on the photosensitive belt;

an intermediate image transfer drum, disposed in the housing on a second side of the photosensitive belt opposite to the first side of the photosensitive belt relative to the long dimension of the elongated loop, onto which the toner image on the photosensitive belt is transferred, the toner image on the intermediate transfer drum subsequently being transferred from the intermediate transfer drum to a recording sheet;

a cleaning unit, disposed in the housing, which removes residual toner from the photosensitive belt at a cleaning position after the toner image on the photosensitive belt has been transferred to the intermediate transfer drum; and a fixing unit, disposed in the housing such that the intermediate transfer drum is between the fixing unit and the second side of the photosensitive belt, which fixes the toner image on the recording sheet;

wherein the photosensitive belt is arranged so that the joint is outside the cleaning unit while the photosensitive belt is being conveyed past the exposing position during the electrostatic latent image forming operation; and wherein a distance along the photosensitive belt from the cleaning position to the exposing position is shorter than a distance along the photosensitive belt from a rear end of the image forming region on the photosensitive belt to a front end of the image forming region on the photosensitive belt.

6. An image forming apparatus according to claim 5, further comprising a plurality of rollers, disposed in the housing, around which the photosensitive belt is stretched;

wherein the charging unit, the exposing unit, and the cleaning unit are arranged around one of the rollers.

7. An image forming apparatus according to claim 5, further comprising a drive roller, disposed in the housing, around with the photosensitive belt is stretched, the drive roller imparting a driving force to the photosensitive belt to convey the photosensitive belt:

wherein the charging unit, the exposing unit, and the cleaning unit are arranged around the drive roller.

8. An image forming apparatus according to claim 5, wherein the at least one developing unit includes at least three different color developing units stacked vertically one above another on the first side of the photosensitive belt above the exposing unit;

wherein the at least three different color developing units sequentially form at least three different color toner images on the photosensitive belt;

wherein the at least three different color toner images are sequentially transferred from the photosensitive belt to the intermediate transfer drum where the at least three different color toner images are stacked one on top of another to form a stacked color toner image on the intermediate transfer drum; and wherein the stacked color toner image is transferred from the intermediate transfer drum to the recording sheet.

9. An image forming apparatus comprising:

a photosensitive belt;

a drive roller around which the photosensitive belt is stretched, the drive roller imparting a driving force to the photosensitive belt to convey the photosensitive belt;

a charging unit which uniformly charges the photoconductive surface of the photosensitive belt to a predetermined electric potential at a charging position where the photosensitive belt is in full contact with the drive roller;

an exposing unit which forms an electrostatic latent image on the uniformly charged photosensitive belt by irradiating a beam onto the photosensitive belt at an exposing position where the photosensitive belt is in full contact with the drive roller;

a developing unit which develops the electrostatic latent image on the photosensitive belt with a toner, thereby forming a toner image on the photosensitive belt;

an intermediate transfer drum onto which the toner image on the photosensitive belt is transferred; and a cleaning unit which removes residual toner from the photosensitive belt at a cleaning position where the photosensitive belt is in full contact with the drive roller after the toner image on the photosensitive belt has been transferred to the intermediate transfer drum;

wherein the charging position is disposed between the cleaning position and the exposing position.

10. An image forming apparatus according to claim 9, wherein the developing unit sequentially forms a plurality of toner images on the photosensitive belt; and wherein the plurality of toner images are sequentially transferred from the photosensitive belt to the intermediate transfer drum where the plurality of toner images are stacked one on top of another to form a stacked toner image on the intermediate transfer drum.

11. An image forming apparatus according to claim 9, wherein the exposing unit includes:

a beam emitter, disposed lower than the exposing position, which emits the beam in a horizontal direction; and a beam director which directs the beam emitted by the beam emitter up to the exposing position.

12. An image forming apparatus according to claim 11, wherein the beam director includes a mirror which deflects the beam.

* * * * *